United States Patent [19]

Christ-Janer

[11] 4,446,668

[45] May 8, 1984

[54] STRUCTURAL MEMBER SUITABLE FOR USE AS A JOIST, BEAM, GIRDER OR THE LIKE

[76] Inventor: Victor F. Christ-Janer, 4 Forest St., New Canaan, Conn. 06840

[21] Appl. No.: 264,006

[22] Filed: May 15, 1981

Related U.S. Application Data

[63] Continuation-in-part of Ser. No. 966,086, Dec. 4, 1978.

[51] Int. Cl.[3] ..... E04C 3/30

[52] U.S. Cl. ..... 52/729; 52/730

[58] Field of Search ..... 52/729, 730, 376, 720; 244/123, 133, 124, 125; 428/175, 537

[56] References Cited

U.S. PATENT DOCUMENTS

| | | | |
|---|---|---|---|
| 96,793 | 11/1869 | Gatling | 52/376 |
| 139,904 | 6/1893 | Lumus | 52/376 |
| 538,562 | 4/1895 | Viernow | 52/376 |
| 854,391 | 5/1907 | Uoshardt | 52/720 |
| 986,258 | 3/1911 | Yost | 52/84 |
| 2,073,001 | 3/1937 | Coddington | 52/376 |
| 2,085,472 | 6/1937 | Roush | 52/376 |
| 2,230,628 | 2/1941 | Sahlberg | 52/730 |
| 3,241,285 | 3/1966 | Baroni | 52/729 |
| 3,654,741 | 4/1972 | MacDonnel | 52/720 |
| 3,798,861 | 3/1974 | Weiss | 52/305.1 |
| 4,256,790 | 3/1981 | Lackmon et al. | 244/133 |

FOREIGN PATENT DOCUMENTS

| | | | |
|---|---|---|---|
| 80770 | 7/1951 | Czechoslovakia | 52/730 |
| 13332 | 7/1894 | United Kingdom | 52/376 |

*Primary Examiner*—John E. Murtagh
*Assistant Examiner*—Andrew Joseph Rudy
*Attorney, Agent, or Firm*—Fitzpatrick, Cella, Harper & Scinto

[57] ABSTRACT

An elongated structural member, which is suitable for use as a joist, beam, girder or the like, comprises first and second webs, each having a generally arcuate cross-sectional shape and, thus, one convex surface and an opposing concave surface. The webs are disposed in generally mutually parallel relation with their respective convex surfaces in confronting relation, one diverging from the other in both an upper region and a lower region. A wedge is interposed between, conforms to, and is intimately joined to the confronting convex surfaces of the webs in at least a portion of each of the upper and the lower regions. The webs are made of plywood and the wedges are made of solid wood. The wedges are capable of bearing substantial compression and tension loads so that together with the portions of the webs to which they are intimately joined, they can accept and support great loads on the member when mounted in span. More particularly, each wedge has a tension or tensile strength on the order of at least 950 pounds per square inch and a compressive strength on the order of at least 950 pounds per square inch.

6 Claims, 5 Drawing Figures

STRUCTURAL MEMBER SUITABLE FOR USE AS A JOIST, BEAM, GIRDER OR THE LIKE

BACKGROUND OF THE INVENTION

This application is a continuation-in-part of U.S. patent application No. 966,086 filed Dec. 4, 1978.

FIELD OF THE INVENTION

The present invention relates to an elongated structural member that is suitable for use as a joist, beam, girder, or similar member.

Structural members such as those mentioned above typically are mounted horizontally, supported at their ends to bear a verticle load. Many forms of such structural members made from various materials are known. Perhaps the most simple is that having a rectangular cross-section shape and made from solid or laminated wood. I- shaped metal beams are also known and are often used in larger scale construction. However, it is desirable to provide building components that are less expensive to produce, more easily handled, yet which provide structural strength in building constructions that equals or exceeds known components. Specifically, solid or laminated wooden beams require resource lumber having diameter at least equal to the major cross-sectional dimension of the beam. The time and raw materials necessary to grow such lumber are excessive. Furthermore, these beams and many metal beams are massive and difficult to manipulate during construction operations.

DESCRIPTION OF THE PRIOR ART

Because of the disadvantages associated with common structural members used for beams, joists, girders and the like, various alternative structures have been proposed. For example, U.S. Pat. Nos. 2,099,470 (Coddington) and 2,073,001 (Coddington) both disclose structural members having a sheet-metal skin which encloses a cementitious infill material. More particularly, the '001 Coddington patent discloses a stud having four metal parts, two of which have an arcuate cross-sectional shape joined to each other with their convex surfaces in confronting relation. Generally V-shaped spaces between the arcuate members, above and below the region in which they are joined are enclosed by cover members. The cementitious infill material comprises a mixture of gypsum, Portland cement and saw dust that prevents the metal skin from collapsing and receives and holds nails that are driven into it. The '470 Coddington patent discloses a generally similar structure.

The members disclosed in each Coddington patent are used primarily as framing members and as described are not believed to be well suited for use in horizontal span to bear large loads. This is because the cementitious infill material in both is virtually incapable of bearing tension loads and the sheet-metal skin of both, including the covers for the V-shaped spaces, therefore becomes the primary load bearing element.

Still other structural members are known. For example, U.S. Pat. No. 426,558 (Dithridge) discloses a beam or girder that comprises opposing tubular edges integrally joined by a connecting plate. Various tubular edge shapes are suggested.

Fabricated wooden structures have also been proposed. For example, U.S. Pat. No. 2,230,628 (Sahlberg) discloses a wooden girder, one embodiment of which is a box beam that comprises two end flanges or chord members joined at their outer edges by two opposing web plates to define an open rectangular cross-section. A second embodiment is an I-beam structure in which end flanges or chord members are joined at their centers by a single interconnecting web that may be reinforced with vertically extending straps. U.S. Pat. No. 4,074,498 (Keller et al.) discloses a structure, similar to the I-beam structure shown in the Sahlberg patent, that incorporates a web having a series of laminated layers of wood joined to the centers of opposing flanges or chord members. Tongues on the respective layers of the web are interfitted in appropriate grooves formed on the faces of the respective top and bottom flanges, the tongues on the outer layers being bent outwardly by splayed outer grooves in each flange to allegedly form a self-locking dovetail joint.

SUMMARY OF THE INVENTION

It is an object of the present invention to provide an improved structural member for use as a joist, beam, girder or the like that has relatively low mass and weight and is, therefore, easily handled at a construction site, yet which is also capable of bearing heavy loads.

It is a further object of the present invention to provide such a structural member that is fabricated from relatively few component parts which may be easily assembled.

It is yet another object of the present invention to provide a structural member that may be made from relatively inexpensive materials, especially wood, that requires stock of much smaller size than that required for solid wooden beams. Production of the structural member of the present invention, therefore, requires less raw material as well as less energy.

In accordance with the present invention, the structural member of the present invention comprises a first and a second web, each web having a generally arcuate cross-sectional shape and, thus, one generally convex surface and an opposing generally concave surface. The webs are disposed in mutually parallel relation with the convex surfaces in confronting relation and diverging from one another in both an upper and a lower region. It is preferred that each web be made of plywood.

A wedge assembly is interposed between, conforms to, and is intimately joined to the confronting convex surfaces of the webs in at least a portion of both the upper and lower regions. In the preferred embodiment the webs are joined together in an intermediate region between the upper and lower regions. The wedge assembly comprises an upper wedge that is interposed between and is joined to the confronting web faces in the upper region and a lower wedge that is interposed between and is joined to the confronting web faces in the lower region. Both the upper and lower wedges are capable of bearing both substantial compression and substantial tension loads without structural failure and are preferably made of a solid wood such as Douglas fir.

Accordingly, the structural member of the present invention is generally X-shaped in cross-section. The interaction between the respective first and second webs and the wedges provide surprisingly high load bearing capability when the structural member of the invention is horizontally supported at its ends and is vertically loaded intermediate its ends. The upper wedge together with portions of the webs to which it is intimately joined accept and supports load on the member in compression while the lower wedge together with portions of the webs to which it is intimately joined accept and support load on the member in tension.

The structural member of the invention has significantly less mass than a solid beam having rectangular cross-section of similar height and width and made of the same material since material within the concave surfaces of the webs is eliminated. When made of wood as preferred, the structural member requires much smaller resource trees than those required to make solid wooden beams having similar rectangular cross-sectional dimensions. Furthermore, the structural member of the invention includes only four basic components and may be easily constructed and assembled.

Accordingly, the structural member of the present invention provides substantial improvements over other such members known in the art.

Other objects, features, and advantages of the present invention will be pointed out in or will be understood from the following detailed description provided below in conjunction with the accompanying drawings.

DETAILED DESCRIPTION OF THE DRAWINGS

DETAILED DESCRIPTION OF THE PREFERRED EMBODIMENTS

Figure 1:
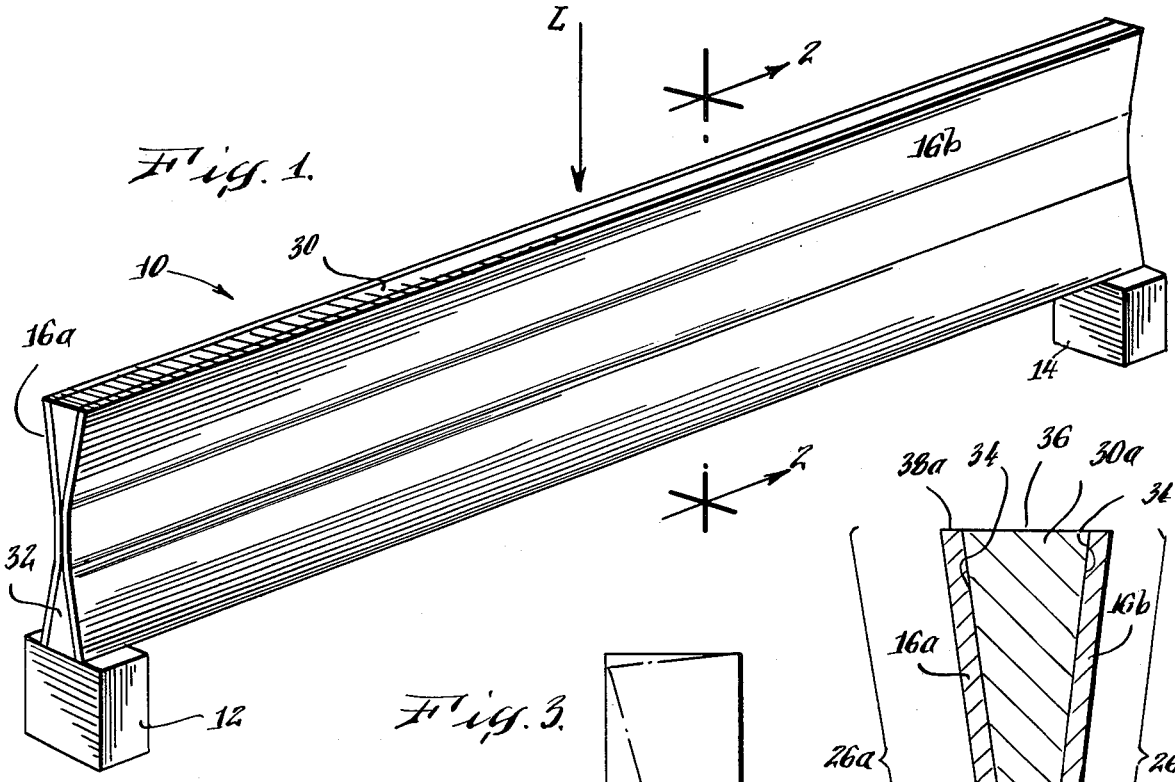
FIG. 1 is a perspective view of the structural member of the present invention mounted as it might be in a building construction.

FIG. 1 illustrates the structural member of the present invention, generally indicated at 10, mounted to horizontally span the distance between two bases 12 and 14 and support a vertical load L. As shown in greater detail in FIG. 2, the member comprises first and second webs 16*a* and 16*b*, respectively, which in the preferred embodiment are one-quarter inch plywood sheets, but which may have other dimensions of length, width and thickness, as desired. Each web is generally arcuate in cross-section and thus has a generally convex surface 20 and an opposing concave surface 22.

Figure 2:
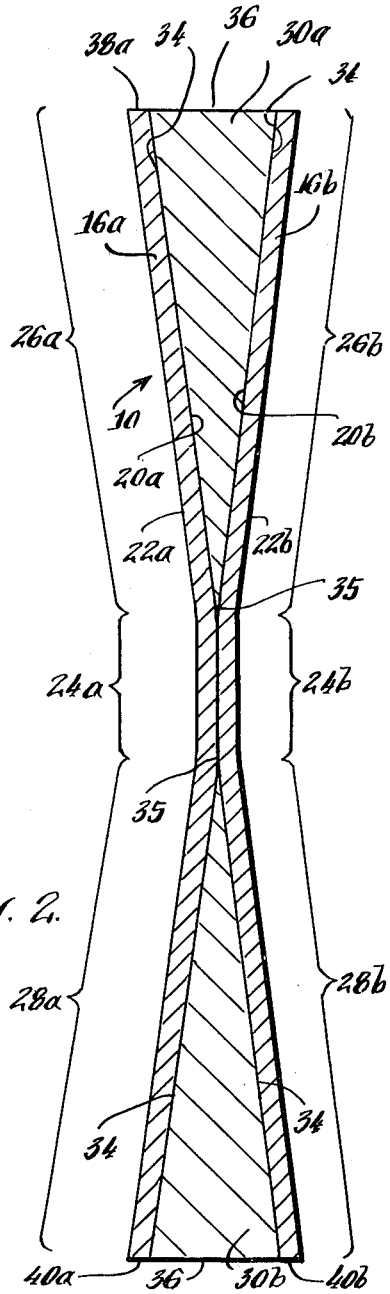
FIG. 2 is an enlarged vertical cross-sectional view taken through plane 2—2 in FIG. 1.

For the purpose of this specification and the concluding claims, it is to be understood that the term "generally arcuate" is intended to mean bowed or curved, whether or not conforming to a circular arc. Specifically, as can be seen in FIG. 2, each web comprises three generally planar sections including a central or intermediate section 24, an upper section 26 and a lower section 28, the upper and lower sections being bent or curved in continuous fashion from the intermediate section 24. Each web is nevertheless considered to be generally arcuate for purposes of this specification and the concluding claims.

The first and second webs 16*a* and 16*b* are positioned in generally parallel relation as can be seen in FIG. 1, with their respective convex surfaces 20*a* and 20*b* in confronting relation and diverging both in the region of the upper sections 26*a* and 26*b* and of lower sections 28*a* and 28*b*. Moreover, in the first embodiment, the convex surfaces of the webs are joined together by a suitable high strength wood adhesive in the region of their respective intermediate sections 24.

Continuous upper and lower wedge elements 30*a* and 30*b*, which in the preferred embodiment are solid wood, are inserted between the first and second webs respectively in the regions of the upper and lower web sections 26 and 28 to maintain the diversing relationship of the webs in these regions as described above. Further, each wedge is secured to the respective webs with its side surfaces 34, diverging from a wedge vertex 35, in intimate contact with and joined to the diverging side convex surfaces 20 of the respective webs. Again, a suitable high strength wood adhesive may be used to join the wedges to the webs.

The base 36 of each wedge 30*a* and 30*b* is co-extensive with, and as can be seen in FIG. 1, spaces apart and extends parallel to, respectively, the top edges 38*a* and 38*b* and bottom edges 40*a* and 40*b* of the webs 16*a* and 16*b*. The intermediate section 24 of each web is, of course, between the respective top and bottom edges of that web.

As noted, in the preferred embodiment, the wedges are made of solid wood because it is readily available in needed sizes and, importantly because it is capable of bearing both substantial tension and substantial compression loads. The forces operating on the member of the invention when loaded will be described in greater detail below. For example, as reported in Ramsey and Sleeper, *Architectural Graphic Standards* (1957) at Table II, page 17, the tension or tensile strength of coastal region Douglas fir, commercial grade dense select structural is on the order of 2150 pounds per square inch. The tension or tensile strengths of other examples of types and grades of woods commonly used in construction applications and which may be used particularly appropriately as the wedges in the structural member of the present invention are listed below in Table I.

TABLE I

| Wood | Grade | Tensile Strength ($lb/in^2$) |
|---|---|---|
| 1. Eastern Hemlock | utility structural | 950 |
| | prime structural | 1200 |
| | select structural | 1300 |
| 2. Southern long-leaf pine | select structural | 2400 |
| 3. Coastal Region Douglas fir | commercial No. 1 | 1450 |
| | dense No. 1 | 1700 |
| | select structural | 1900 |
| | dense select structural | 2150 |

Similarly, the compressive strengths of woods suitable in the member of the invention are on the same order. Examples of the compressive strengths of such woods as reported in *Architectural Graphic Standards* are listed in Table II below.

TABLE II

| Wood | Grade | Tensile Strength ($lb/in^2$) |
|---|---|---|
| 1. Southern long leaf pine | structural S.E. & S. | 1300 |
| | long leaf | 1150 |

TABLE II-continued

| Wood | Grade | Tensile Strength (lb/in$^2$) |
|---|---|---|
| | dense No. 1 structural | |
| 2. Coastal Region Douglas fir | dense No. 1 | 1400 |

When the member is mounted horizontally and loaded at midspan, the lower wedge 30b is placed in tension and the upper wedge 30a is placed in compression. These tension and compression forces are managed effectively by the inter-action of the respective wedges and the webs to which they are intimately joined by the high strength adhesive. The management of tension and compression forces in the member 10 results in surprising load bearing capability.

Generally, then, materials, preferably wood, having a tensile or tension strength of at least about 950 pounds per square inch are suitable for use as the wedges in the structural member of the invention.

The lower wedge is more likely to fail in tension than is the upper wedge in compression. Therefore, the minimum acceptable compressive strength for the upper wedge material may be as low as the minimum acceptable tensile strength of the upper wedge material that is a minimum acceptable compressive strength for the upper wedge material is on the order of 950 pounds per square inch.

Experiments have been conducted with a structural member having the construction described above with webs made of ¼ inch marine grade plywood of Douglas fir and wedges each made of solid Douglas fir and having nominal dimensions of 2 inch×14 inch×16 foot. Supported horizontally at its ends, such a member was loaded uniformly along its length with concrete blocks and supported a total of 15,000 pounds of vertical load prior to failing. Based on such a test it has been concluded that such a structural member is capable of supporting a 750 pounds per linear foot when the webs 16a and 16b are made of the specified materials. The surprising load bearing capability of the member of the invention is especially striking when it is compared with standard members. For example, a 2 inch by 14 inch by 16 foot solid douglas fir beam has an allowable load of about only about 170 pounds per linear foot when supported horizontally at its ends.

In addition to its surprising load bearing capability, the structural member of the invention also offers several other advantages over prior art members.

Figure 3:
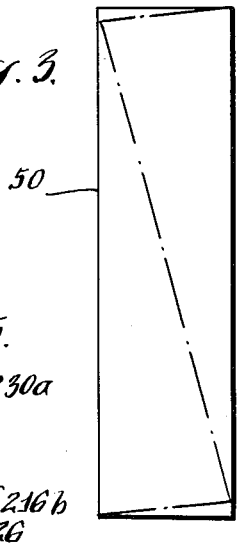
FIG. 3 is a vertical cross-sectional view of a piece of lumber from which the upper and lower wedges may be cut.

First it can be made with substantially smaller resource trees than can solid wooden beams of comparable size. As shown in FIG. 3, a piece of lumber 50 which is used as raw stock is lined for wedges for making the structural member having dimensions described above. This stock is approximately 5½" high and 1 7/16" wide and has length equal to the desired length of the structural member to be made. Therefore, it is readily apparent that the solid stock required to make a 2"×14" structural member in accordance with the invention is much smaller than solid stock necessary to make a solid 2"×14" beam. Accordingly, the time and other resources necessary to grow trees from which the structural member of the present invention is made are much less than that required to make a solid beam.

Second, as can be seen in FIG. 2, the mass of the member made in accordance with the present invention is significantly lower than that of a solid beam, all material which ordinarily would occupy the concave areas on either side thereof having been eliminated.

Therefore, the present invention constitutes a significant improvement over prior art structures, since it can be economically manufactured, its mass is significantly less and, therefore, it is more easily handled. Yet, it provides superior load bearing capability. The member 10 may be provided with a limited number of holes drilled laterally therethrough to support cross members, as cable guides, or to serve as attachment points for other appliances without significantly alternating its load bearing capability.

Figure 4:
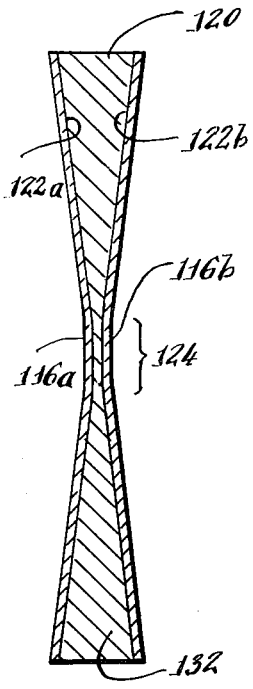
FIG. 4 is a vertical cross-sectional view similar to that shown in FIG. 2 of a second embodiment of the present invention.

A second embodiment of the present invention is shown in FIG. 4 and comprises first and second webs 116a and 116b, which have a generally arcuate cross-sectional shape. A wedge member 120 is interposed between the webs. However, the webs are not joined together in the region of an intermediate section 124 but instead, the wedge 120 comprises a single element that is intimately joined to and conforms to the respective convex surfaces 120a and 120b of the webs 116a and 116b.

Figure 5:
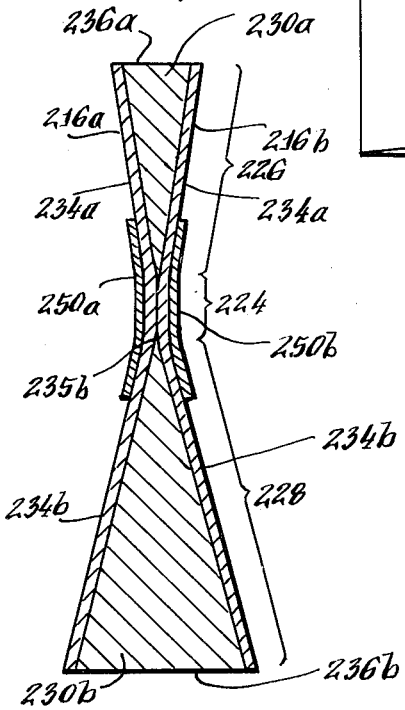
FIG. 5 is a vertical cross-sectional view similar to that shown in FIG. 2 of a third embodiment of the present invention adapted for high load bearing applications.

FIG. 5 illustrates a third embodiment of the present invention that is designed for heavy load bearing applications. Therein, the webs 216a and 216b are joined together in an intermediate region at their intermediate sections 224 in a fashion similar to that described with reference to the first embodiments. Two separate wedge members 230a and 230b are inserted between and joined to the webs in the regions of their upper and lower sections 126 and 128. However, the lower wedge 230b is provided with a base 236b that is wider than the base 236a of the upper wedge 230a. Moreover, the lower sections 228 of the respective webs and, hence, the length of the diverging surfaces 234b of the lower wedge 236b from the wedge vertex 235b to the base 236b are longer than the comparable dimensions of the diverging web surfaces and upper wedge surfaces 234a in the region of the upper section 226. Accordingly, the lower wedge being of larger stock is capable of withstanding larger tension forces and, hence, enhances the total load bearing capability of the structure.

An alternative or additional reinforcement to improve load bearing capability of the structural member of any of the illustrated embodiments may be provided by reinforcing webs 250a and 250b joined to the outer concave surfaces of the respective main webs 216a and 216b in the region of their central sections 224 and at least a portion of the regions of their upper and lower sections 226 and 228. These reinforcing webs improve the management of the tension and compression forces between the respective upper and lower wedges and the respective webs to enhance the load bearing capabilities of the structure.

Accordingly, it will be appreciated that the structural member of the present invention provides many advantages over prior structures. Therefore, although specific embodiments of the present invention have been disclosed above in detail, it will be understood that this is for purposes of illustration. Modification may be made to these described structures in order to adapt them to particular applications for supporting loads in construction.

What is claimed is:

1. An elongated joist, beam, girder or similar structural member, comprising:

first and second elongated plywood webs each having a generally arcuate cross-sectional shape and, thus, one generally convex surface and an opposing generally concave surface, said webs being disposed in generally mutually parallel relation with said convex surfaces in mutually confronting relation, one of said convex surfaces diverging from the other thereof in both an upper generally V-shaped region and a lower generally V-shaped region, said webs thereby defining two parallel spaced top edges and two parallel spaced bottom edges; and upper and lower generally V-shaped structural wedges interposed between and conforming to said confronting convex surfaces of said first and second webs throughout their length in respectively said upper region and said lower region; and adhesive means intimately and continuously joining each of said upper and lower wedges in the respective upper and lower regions with the V-shaped surfaces of said wedges intimately and continuously joined to the respective confronting convex surfaces of said first and second webs;

said upper wedge having a base substantially coextensive with and spanning the distance between said spaced top edges of said webs and together therewith defining an exposed upper load supporting surface, said lower edge also having a base substantially coextensive with and spanning the distance between said spaced bottom edges of said webs and together therewith defining an exposed base surface, said upper wedge consisting of a wood material selected from the group of wood materials capable of bearing substantial compression loads of at least about 950 pounds per square inch without structural failure in order to, together with the portions of said webs to which it is intimately joined by said adhesive means, accept and support load on said upper load supporting surface of said member in compression and said lower wedge consisting of a wood material selected from the group of wood materials capable of bearing substantial tension loads of at least about 950 pounds per square inch without structural failure in order to, together with the portions of said webs to which it is intimately joined by said adhesive means, accept and support load on said member in tension.

2. The elongated structural member as claimed in claim 1, wherein said webs are joined together in a region intermediate said top and said bottom edges.

3. An elongated joist, beam, girder or similar structural member, comprising:

first and second elongated plywood webs disposed in generally mutually parallel relation, each web having opposing top and bottom edges and confronting web faces joined together in a region intermediate said opposing top and bottom edges of said first and said second webs;

an upper generally V-shaped wedge interposed between and conforming to said confronting faces of said first and second webs throughout their length in an upper generally V-shaped region above said intermediate region to space the respective top edges of said first and second webs apart;

first adhesive means for intimately and continuously joining said upper wedge in said upper region with the V-shaped surfaces of said upper wedge intimately and continuously joined to the respective confronting surfaces of said first and second webs in said upper region;

said upper wedge having a base substantially coextensive with and spanning the distance between said top edges and together therewith defining an exposed upper load supporting surface, said upper wedge further consisting of a wood material selected from the group of wood materials capable of bearing a substantial compression load of at least 950 pounds per square inch without structural failure in order to, together with the portions of said webs to which it is joined by said first adhesive means, accept and support load on said member in compression;

a lower generally V-shaped wedge interposed between and conforming to said confronting faces of said first and second webs throughout their length in a lower generally V-shaped region below said intermediate region to space the respective bottom edges of said first and said second webs apart; and second adhesive means for intimately and continuously joining said lower wedge in said lower region with the V-shaped surfaces of said lower wedge intimately and continuously joined to the respective confronting surfaces of said first and second webs in said lower region;

said lower wedge also having a base substantially coextensive with and spanning the distance between said spaced bottom edges and together therewith defining an exposed base surface, said lower wedge consisting of a wood material selected from the group of wood materials capable of bearing a substantial tension load of at least 950 pounds per square inch without structural failure in order to, together with the portions of said webs to which it is joined by said second adhesive means, accept and support load on said member in tension.

4. The structural member as claimed in claim 3, wherein said base of said lower wedge is wider than said base of said upper wedge.

5. The structural member as claimed in claim 3, wherein each of said upper and said lower wedges has diverging surfaces intersecting at a vertex and spaced apart by its respective base remote from said vertex, said diverging surfaces of said lower wedge having length from said vertex to said base thereof longer than the comparable length of said upper wedge.

6. The structural member as claimed in claim 3, further comprising secondary web means joined in intimate contact with said first and said second web at least in said intermediate region.

* * * * *